US005187910A

United States Patent [19]

Nicholas et al.

[11] Patent Number: 5,187,910

[45] Date of Patent: Feb. 23, 1993

[54] FIRE BARRIER SYSTEM

[75] Inventors: John D. Nicholas, Lawrenceville; Randy L. Hensley, Duluth, both of Ga.

[73] Assignee: MM Systems Corporation, Tucker, Ga.

[21] Appl. No.: 415,644

[22] Filed: Oct. 2, 1989

[51] Int. Cl.[5] ..... E04B 1/94

[52] U.S. Cl. ..... 52/317

[58] Field of Search ..... 52/406, 407, 404, 573, 52/232, 317, 393, 395, 396, 238, 241; 109/79-84

[56] References Cited

U.S. PATENT DOCUMENTS

| | | | |
|---|---|---|---|
| 1,389,557 | 8/1921 | Een | 52/393 |
| 1,807,395 | 5/1931 | Ellis . | |
| 1,832,105 | 11/1931 | Ellis . | |
| 2,215,894 | 9/1940 | Waterman | 52/795 |
| 2,750,313 | 6/1956 | Schwartz | 52/406 |
| 2,786,004 | 3/1957 | Schwartz | 52/406 |
| 3,543,460 | 12/1970 | Stastny et al. | 52/232 |
| 3,757,477 | 9/1973 | McCrillis | 52/317 |
| 3,759,008 | 9/1973 | Husz | 52/573 |
| 3,786,604 | 1/1974 | Kramer . | |
| 4,154,041 | 5/1979 | Namy | 52/573 |
| 4,381,634 | 5/1983 | Hounsel | 52/404 |
| 4,563,848 | 1/1986 | Gartner | 52/235 |
| 4,566,242 | 1/1986 | Dunsworth | 52/573 |
| 4,649,129 | 3/1987 | Dunsworth . | |
| 4,756,945 | 7/1988 | Gibb . | |
| 4,811,529 | 3/1989 | Harris et al. . | |
| 4,825,617 | 5/1989 | Kinoshita et al. . | |
| 4,897,976 | 2/1990 | Williams | 52/586 |
| 4,932,183 | 6/1990 | Coulston | 52/396 |
| 4,936,064 | 6/1990 | Gibb | 52/232 |
| 4,942,710 | 7/1990 | Rumsey | 52/573 |

*Primary Examiner*—Richard E. Chilcot, Jr.
*Assistant Examiner*—C. Smith
*Attorney, Agent, or Firm*—Jones, Askew & Lunsford

[57] ABSTRACT

An improved fire barrier system is disclosed for interposition within an expansion joint between adjacent wall or floor members. In the disclosed embodiment, the invention is characterized in that the fire barrier system is symmetrical in both pairs of opposing quadrants defined by a first axis parallel to and midway between said mutually facing walls and transverse to said direction of elongation and a second axis transverse to said first axis and to said direction of elongation. This symmetry affords equal resistance to fire from either side of the barrier, eliminates the possibility of the joint being installed backwards, and permits the barrier system to be fire-rated for resistance to fire from either side of the barrier on the basis of a single test.

8 Claims, 1 Drawing Sheet

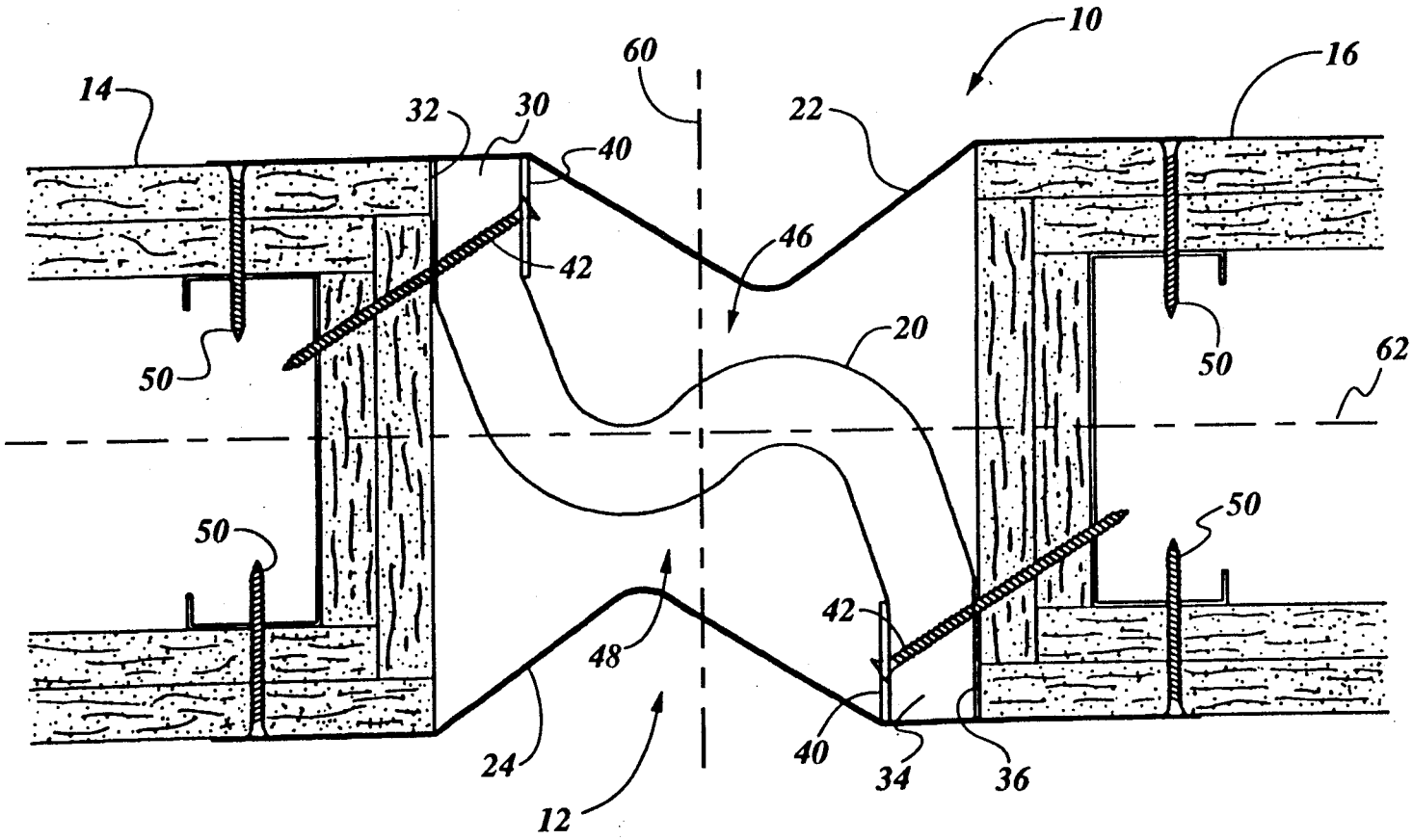
10
12
14
16
20
22
24
30
32
34
36
40
42
46
48
50
60
62

FIRE BARRIER SYSTEM

TECHNICAL FIELD

The present invention relates generally to fire barriers for buildings, and relates more specifically to an improved fire barrier system for interposition within a building joint between adjacent wall or floor members which affords equal resistance to fire from either side of the barrier.

BACKGROUND OF THE INVENTION

Current state-of-the-art fire protection engineering technology relies heavily upon sprinkler systems to contain and control fire in a building. Sprinklers are active systems which require water pressure, pumps, and piping. If any of these three components are damaged, the entire system is usually rendered useless. Such damage to sprinkler system components can occur in many ways. For example, if an earthquake severs a water main and effects water pressure, the sprinkler system may not operate. Or, if a fire occurs during an electrical blackout, or if the fire damages the building's electrical system, the pumps may be rendered inoperative. Relatively less attention has been paid to compartmentalization and fire resistive construction. These so-called "passive systems," while not providing the advantages of a sprinkler system with regard to extinguishing a fire, nonetheless afford significant advantages in terms of containing a fire. Once these passive systems are properly installed, there is no dependency upon outside factors to perform their tasks. Additionally, the cost of such systems is usually substantially less than a sprinkler system.

In the field of fire resistive construction, very little attention has been paid to the structural voids or separations, commonly called "joints," in buildings and parking structures. Such joints typically occur between adjacent wall structures or adjacent floor structures and are often found in roof construction. Joints may be either static or dynamic, a dynamic joint being a joint which opens and closes to accommodate movement of the adjacent structures such as wind loading or thermal expansion and contraction. An apparatus installed within a static joint to inhibit the spread of fire through the joint is commonly referred to as a "fire stop," while an apparatus installed within a dynamic joint to inhibit the spread of fire is commonly referred to as a "fire barrier." However, for the sake of convenience, the term "fire barrier" as used herein will be understood to encompass both fire stops and fire barriers. If a joint is not fire protected, a devastating catastrophic results called the "chimney effect" can cause fire, toxic gases, and smoke to spread rapidly throughout the structure. Thus, there is a need to provide a fire barrier system to prevent the rapid spread of fire, smoke, and toxic gases through unprotected joints.

Prior efforts have been made to provide fire barrier systems to prevent the spread of fire through joints. However, these prior art systems typically suffer a number of disadvantages. First, the majority of such systems are "directional" in nature, meaning that they resist the spread of fire from one side of the barrier better than from the other side. While such systems might be acceptable if it could always be known on which side of the joint a fire will occur, such is seldom the case. Thus, in order to afford the desired degree of protection, the fire barrier must be selected so that its less resistant side meets the necessary requirements. Consequently, the other side of the fire barrier may provide substantially more protection than is actually needed. While there is no disadvantage per se to extending the desired degree of protection, such excess generally translates into increased expense of the fire barrier. Alternatively, mutually opposing fire barrier systems may be installed within the same joint, each of which meets the minimum standard. Again, however, the installation of two separate barriers results in increased cost of installation.

Another problem arises in testing prior art fire barriers to determine their fire resistance rating. A nationally accepted and utilized fire test standard called ASTM E119, Standard Test Methods for Fire Test of Building Construction and Materials, rates a wall construction in terms in the length of time which the wall construction maintains all the criteria of the fire test standard. With prior art fire barrier systems, it has been necessary to conduct two separate tests of a given wall construction, one test from either side of the asymmetrical fire barrier, to assign separate ratings to each side of the fire barrier. Since the expense associated with conducting a single test is considerable, it would be desirable to provide a fire barrier system whereby both sides of the barrier can be rated without requiring multiple tests.

SUMMARY OF THE INVENTION

As will be seen, the present invention overcomes these and other disadvantages associated with prior art fire barrier systems for building joint construction. Stated generally, the present invention comprises a fire barrier for preventing the spread of fire, smoke, and toxic gases through a building joint which is equally fire-resistant on both sides of the barrier. Further, both sides of the fire barrier system can be rated according to nationally accepted and utilized fire test standards based upon the results of only a single test. Thus, testing costs are dramatically reduced. Finally, the fire barrier system is economical to manufacture and easy to install and is appropriate for use in wall joints, floor joints, and roof joints.

Stated somewhat more specifically, the present invention relates to fire barrier for preventing a fire from spreading through the joints of a building wherein the fire barrier includes a thermally insulating blanket spanning the joint and being anchored on both sides thereof. A first exterior barrier disposed on one side of the blanket spans the joint and is anchored on both sides thereof, and a second exterior barrier disposed on the side of the blanket opposite the first exterior barrier likewise spans the joint and is anchored on both sides thereof. In a first aspect, the fire barrier system of the present invention is characterized in that the system exhibits "cartesian point symmetry," that is, the barrier system is symmetrical in both pairs of opposing quadrants defined by a first axis parallel to and midway between the mutually facing walls and transverse to the direction of elongation and a second axis transverse to the first axis and to the direction of elongation.

In a second aspect, each of the two exterior barriers defines an air pocket between the respective barrier and the insulating blanket, the two air pockets thus defined being configured substantially identically.

Thus, it is an object of the present invention to provide an improved fire barrier system for building joint construction.

It is a further object of the present invention to provide a fire barrier system which resists fire equally well from both sides of the barrier.

It is yet another object of the present invention to provide an improved fire barrier system wherein both sides of the fire barrier may be rated according to nationally accepted and utilized fire test standards based upon the results of a single test.

A further object of the present invention is to provide an improved fire barrier system which is economical to manufacture and easy to install.

Other objects, features, and advantages of the present invention will become apparent upon reading the following specification, when taken in conjunction with the drawing and the appended claims.

BRIEF DESCRIPTION OF THE DRAWING

The FIGURE shows a top view of a fire barrier system according to the present invention installed within a building joint between adjacent wall structures.

DETAILED DESCRIPTION OF THE DISCLOSED EMBODIMENT

Referring now to the drawing, the FIGURE discloses a fire barrier system 10 according to the present invention. The fire barrier system 10 is depicted installed within a joint 12 between a pair of adjacent wall structures 14, 16. The figure depicts a top view of the joint 12 with fire barrier system 10 installed, and it will be understood that the joint and fire barrier system are of a substantially constant cross-section and are elongated in a direction which is perpendicular to the sheet upon which the drawing appears.

The fire barrier system 10 comprises a central fire-resistive insulating blanket 20 and first and second exterior barriers 22, 24. The insulating blanket 20 of the disclosed embodiment is comprised of a ceramic fiber insulating material formed from kaolin. Kaolin clay is heated to a temperature of 3800° F. to liquify the material. The liquid ceramic material is then drawn through a small opening to form a thin stream, and the liquid stream is cooled with a fan to solidify the kaolin into a ceramic fiber. The fiber is collected in a chute and kneaded into a blanket. Thereafter, the ceramic material can withstand temperatures of up to 3200° F. before the material begins to degrade. In the disclosed embodiment, the insulating material is comprised of Kaowool®, a ceramic fiber insulation manufactured by Thermal Ceramics. However a number of other ceramic fiber insulating blankets are suitable for use, including Fiberfrax TM, by Carborundum; Cer-Wool® by Combustion Engineering; Cereblanket TM, from Johns-Manville; and Tnemeshield TM, by Bio Fireshield, Inc. Also, it will be understood that while ceramic fiber insulating blankets are preferred, the present invention is by no means limited to such ceramic materials and may encompass a central barrier comprised of any suitable heat-retardant material.

The insulating blanket 20 is installed within the joint first by anchoring one lateral edge 30 of the blanket to one corner 32 of the four inside joint face corners and the other lateral edge 34 to the inside joint corner 36 diagonally opposite the one joint corner 32. The insulating blanket 20 has a width longer than the diagonal distance between the two joint face corners 32, 36. Consequently, when installed within the joint, the insulating blanket adopts a substantially S-shaped cross-sectional configuration. In the disclosed embodiment, a pair of substantially U-shaped cap members 40 are positioned over the lateral edges 30, 34 of the blanket 20. Nails 42 are driven through the U-shaped cap members 40 and into the corresponding wall sections 14, 16. As the nails 42 are driven, the opposing legs of each cap member 40 are compressed, thereby clamping the lateral edges 30, 34 of the blanket 20 within the cap members and simultaneously securing the lateral edges 30, 34 of the blanket to the inside joint corners 32, 36. Thus, the blanket 20 is held in place within the joint 12 both by the nails 42 extending therethrough and by the clamping action of the cap members 40 on the lateral edges 30, 34 of the blanket, the cap members, in turn, being anchored to the respective joint faces 32, 36.

It will be appreciated by those skilled in the art that other means of fastening the lateral edges 30, 34 of the blanket 20 to the opposing joint corners 32, 36 may be employed, including the use of nails 42 without the cap members 40 and the use of heat-resistant adhesives (also known as "fire glue") to bond the lateral edges of the blanket to the respective joint faces.

After the fire-resistive insulating blanket 20 is installed between the joint faces within the joint cavity 12 in the manner just described, the pair of V-shaped exterior barriers 22, 24 are fastened across the joint opening to each of the adjacent wall structures 14, 16. The exterior barriers 22, 24 comprise the front and rear faces of the fire barrier system 10. The exterior barriers 22, 24 further define opposing air spaces 46, 48 between their interior faces and the mutually facing surfaces of the insulating blanket 20.

The opposing edges of each of the exterior barriers 22, 24 of the disclosed embodiment are secured to the mutually opposing joint faces by driving nails 50 through the edges of the barriers and into the respective wall members 14, 16. However, it will be appreciated that suitable alternative means for fastening the exterior barriers 22, 24 may be employed, including heat-resistive adhesives.

The exterior barriers 22, 24 of the disclosed embodiment are comprised of a stainless steel foil approximately 0.002 inches thick. However, the exterior barriers may be comprised of other suitable materials, such as sheet metal or ceramic fabric, depending upon the characteristics required of a particular installation. Ceramic fabrics generally provide better insulating characteristics than metal foils. However, ceramic fabrics suffer the disadvantage that when heated they will not withstand a strong stream of water without rupturing. Thus, exterior barriers comprised of ceramic fabrics are most suitable for use in applications where a joint cover plate over the exterior barrier is desired for aesthetic reasons, so that the separate cover plates can provide the necessary protection against a water stream. On the other hand, exterior barriers comprised of metal foils will better withstand a stream of water without compromising the integrity of the barrier system. Thus, metal foils are especially suitable where a separate cover plate will not be used.

The fire barrier system 10 is especially well suited for use in dynamic joint applications. The S-shaped flexible ceramic insulating blanket and the thin, V-shaped metal foil exterior barriers accommodate movement of the joint, flexing as the joint opens and closes. This flexibility maintains the integrity of the joint against the propagation of heat through the joint irrespective of whether the joint is opened or closed, without impeding normal movement of the joint. As will be appreciated, use of the fire barrier system 10 within a dynamic joint imposes the design limitation that the blanket 20 and exterior barriers 22, 24 must be of sufficient length to span the joint opening when the joint is fully opened.

The fire barrier system of the present invention provides an effective barrier against the transmission of heat through the joint in part because it requires heat to pass through the joint by all three known methods of heat transmission: conduction, radiation, and convection. This characteristic will be explained with reference to the FIGURE, where it will be assumed that a fire is spreading from the side of the barrier at the top of the FIGURE, such that the exterior barrier 22 is the "hot" side of the fire barrier system 10. The fire heats the first foil exterior barrier 22 and passes through by conduction into the first air pocket 46. Next, the heated foil heats the air in the first air pocket, and the heat passes through the air pocket to the insulating blanket 20 by convection (and, to a lesser degree, by radiation). The heat must next pass through the insulating blanket 20 by conduction. The heated back side of insulating blanket 20 then heats the air in second air pocket 48 and passes through the second air pocket to the rear foil exterior barrier 24 by convection (and, again to a lesser degree, by radiation), The heat must next propagate through the rear foil barrier 24 by conduction. Finally, the heat which manages to propagate through the various components of the fire barrier system 10 radiates from back side of rear foil barrier 24.

The fire barrier system 10 of the present invention is characterized by two important features. First, the fire barrier system exhibits "Cartesian plane point symmetry," which is to say that the system is symmetrical in diagonally opposing quadrants defined by a first axis 60 which is parallel to and midway between the mutually facing joint walls and transverse to the direction of elongation and a second axis 62 transverse to the first axis and to the direction of elongation. Second, the air space 46 defined between the insulating blanket 20 and the first exterior barrier 22 is configured substantially identically in both size and shape to the air space 48 defined between the insulating blanket 20 and the second exterior barrier 24. Further, even when used within a dynamic joint, the fire barrier 10 maintains this opposing quadrant symmetry even as the joint opens and closes, and the opposing air spaces 46, 48 retain their substantially identical configuration relative to one another even as the joint moves.

These features provide a number of advantages. First, since the fire barrier system is symmetrical about its transverse midline 62, the barrier system 10 resists the propagation of fire and heat equally well from either exterior face of the barrier system. Thus, there is no need for multiple barrier systems within the joint to resist fire from both directions, nor does the barrier system resist the spread of fire less efficiently from one side than from the other.

A further advantage of the barrier system's symmetry is that the system may be fire-rated for resistance to fire from either direction based upon the results of a single test. Since fire-rating testing is quite expensive, the elimination of one-half of the required testing presents a considerable advantage.

Another advantage of the symmetry of the fire barrier system is that it simplifies installation and eliminates the possibility that an unskilled worker might accidentally install the barrier backwards.

As previously explained, the central insulating blanket 20 of the disclosed embodiment is substantially S-shaped and exhibits the opposing quadrant symmetry which characterizes the present invention. However, it will be appreciated that other insulating blanket configurations which also exhibit the characteristic opposing quadrant symmetry may be used, including a tubular or "O-shaped" insulating blanket or a "Z-shaped" arrangement. Similarly, the exterior barriers 22 are V-shaped in the disclosed embodiment but may be configured in other shapes, such as a U-shape, which provide the desired opposing quadrant symmetry while accommodating joint movement.

While the fire barrier system 10 has been illustrated with respect to a joint between a pair of adjoining wall sections, it will be understood that the fire barrier system is not limited only to joints between wall sections but is also suitable for use in floor joints, roof joints, and any other linear opening in a building construction. Similarly, while the disclosed embodiment is illustrated with respect to a fire barrier system for use within a dynamic joint, that is, a joint which opens and closes to accommodate movement of the adjacent structures such as by thermal expansion and contraction, it will be appreciated that the invention is equally well suited for use as a fire stop in static joint applications.

Finally, it will be understood that the preferred embodiment has been disclosed by way of example, and that other modifications may occur to those skilled in the art without departing from the scope and spirit of the appended claims.

What is claimed is:

1. A fire barrier for preventing a fire from spreading through a dynamic joint of a building, said joint being defined by adjacent walls capable of relative movement such that said joint is capable of opening and closing, and said joint being elongated in a direction of elongation, said fire barrier comprising:

a single thermally insulating blanket having mutually opposing first and second sides, said blanket spanning said joint and being anchored to each of said adjacent walls;

a first cover disposed on the first side of said blanket and having a portion spaced apart therefrom, said first cover spanning said joint and being anchored to each of said adjacent walls; and a second cover disposed on the second side of said blanket and having a portion spaced apart therefrom, said second cover spanning said joint and being anchored to each of said adjacent walls;

said fire barrier being symmetrical in both pairs of opposing quadrants defined by a first axis parallel to and midway between said adjacent walls and transverse to said direction of elongation and a second axis transverse to said first axis and to said direction of elongation, and said insulating blanket and said first and second covers being flexible to accommodate movement of said dynamic joint, said first barrier remaining symmetrical in said both pairs of opposing quadrants as said joint opens and closes.

2. The fire barrier of claim 1, wherein said thermally insulating blanket has a substantially S-shaped configuration.

3. A fire barrier for preventing a fire from spreading through a dynamic joint of a building, said joint being defined by adjacent walls capable of relative movement such that said joint is capable of opening and closing, and said joint being elongated in a direction of elongation, said fire barrier comprising:

a single thermally insulating blanket having mutually opposing first and second sides, said blanket spanning said opening and being anchored to each of said adjacent walls;

a first cover disposed on the first side of said blanket, said first cover spanning said opening and being anchored to each of said adjacent walls so as to define a first air space between said first cover and said first side of said insulating blanket; and a second cover disposed on the second side of said blanket, said second cover spanning said opening and being anchored to each of said adjacent walls so as to define a second air space between said second cover and said second side of said insulating blanket;

said fire barrier being characterized in that said first air space is configured substantially identically in both size and shape to said second air space; and said insulating blanket and said first and second covers being flexible to accommodate movement of said dynamic joint, and said first air space remaining configured substantially identically in both size and shape to said second air space as said joint opens and closes.

4. The fire barrier of claim 3, wherein said thermally insulating blanket has a substantially S-shaped configuration.

5. A fire barrier for preventing a fire from spreading through a dynamic joint of a building, said joint being defined by adjacent walls capable of relative movement such that said joint is capable of opening and closing, and said joint being elongated in a direction of elongation, said fire barrier comprising a thermally insulating blanket spanning said joint and being anchored to each of said adjacent walls, said blanket being symmetrical in both pairs of opposing quadrants defined by a first axis parallel to and midway between said adjacent walls and transverse to said direction of elongation and a second axis transverse to said first axis and to said direction of elongation, and said insulating blanket being flexible to accommodate movement of said dynamic joint, said blanket remaining symmetrical in said both pairs of opposing quadrants as said joint opens and closes.

6. The fire barrier of claim 5, wherein said thermally insulating blanket has a substantially S-shaped configuration.

7. A fire barrier for preventing a fire from spreading through an elongated opening of a building, said opening being defined by adjacent walls, and said opening being elongated in a direction of elongation, said fire barrier comprising:

one and only one thermally insulating blanket having a substantially S-shaped configuration and mutually opposing first and second sides, said blanket spanning said opening and being anchored to each of said adjacent walls;

a first cover disposed on the first side of said blanket and having a portion spaced apart therefrom, said first cover spanning said opening and being anchored to each of said adjacent walls; and a second cover disposed on the second side of said blanket and having a portion spaced apart therefrom, said second cover spanning said opening and being anchored to each of said adjacent walls;

said fire barrier being characterized in that said barrier is symmetrical in both pairs of opposing quadrants defined by a first axis parallel to and midway between said adjacent walls and transverse to said direction of elongation and a second axis transverse to said first axis and to said direction of elongation.

8. A fire barrier for preventing a fire from spreading through an elongated opening of a building, said opening being defined by adjacent walls, and said opening being elongated in a direction of elongation, said fire barrier comprising:

one and only one thermally insulating blanket having a substantially S-shaped configuration and mutually opposing first and second sides, said blanket spanning said opening and being anchored to each of said adjacent walls;

a first cover disposed on the first side of said blanket, said first cover spanning said opening and being anchored to each of said adjacent walls so as to define a first air space between said first cover and said first side of said insulating blanket; and a second cover disposed on the second side of said blanket, said second cover spanning said opening and being anchored to each of said adjacent walls so as to define a second air space between said second cover and said second side of said insulating blanket;

said fire barrier being characterized in that said first air space is configured substantially identically in both size and shape to said second air space.

* * * * *